US006634577B2

(12) United States Patent
Horigane

(10) Patent No.: US 6,634,577 B2
(45) Date of Patent: Oct. 21, 2003

(54) CRUSHER, PROCESS FOR PREPARING AND TESTING MATERIALS AND APPARATUS THEREFOR

(75) Inventor: Akira Horigane, Tsukuba (JP)

(73) Assignees: Tsukuba Food Science, Inc., Ushiku (JP); National Agricultural Research Organization, Tsukuba (JP)

( * ) Notice: Subject to any disclaimer, the term of this patent is extended or adjusted under 35 U.S.C. 154(b) by 0 days.

(21) Appl. No.: 09/803,385

(22) Filed: Mar. 9, 2001

(65) Prior Publication Data

US 2002/0074438 A1 Jun. 20, 2002

(30) Foreign Application Priority Data

Dec. 20, 2000 (JP) ..... 2000-387753

(51) Int. Cl.[7] ..... B02C 1/14; B02C 4/30

(52) U.S. Cl. ..... 241/24.1; 241/235; 241/270; 241/293

(58) Field of Search ..... 100/240; 241/293, 241/236, 270, 262, 283, 24.1, 294, 295, 235

(56) References Cited

U.S. PATENT DOCUMENTS

| | | | |
|---|---|---|---|
| 2,193,163 | A | 3/1940 | Chenoweth |
| 3,862,721 | A | 1/1975 | Flair |
| 5,547,133 | A | 8/1996 | Rogers et al. |

FOREIGN PATENT DOCUMENTS

| | | |
|---|---|---|
| DE | 33 27 814 | 3/1985 |
| FR | 1 048 701 | 12/1953 |
| GB | 144 726 | 8/1921 |
| GB | 557 521 | 11/1943 |
| GB | 1 206 313 | 9/1970 |
| GB | 1 368 335 | 9/1975 |
| RU | 2 099 140 | 12/1997 |

*Primary Examiner*—Mark Rosenbaum
(74) *Attorney, Agent, or Firm*—Flynn, Thiel, Boutell & Tanis, P.C.

(57) ABSTRACT

A crushing apparatus for crushing, blending, homogenizing and transferring materials is made up of a first pressing element having a first pressing face with protrusions provided thereon in the form of isolated islands surrounded by depressed marginal spaces and a second pressing element to be held in engagement with the first pressing element and having a second pressing face with protrusions provided thereon in a similar pattern to the first pressing face. The protrusions of the first and second pressing faces are disposed in relation to each other such that the protrusions of the first or the second pressing element will engage with corresponding depressed marginal spaces on the second or first pressing face of the respective pressing element.

10 Claims, 9 Drawing Sheets

CRUSHER, PROCESS FOR PREPARING AND TESTING MATERIALS AND APPARATUS THEREFOR

FIELD OF THE INVENTION

The present invention relates to a crusher and a process and an apparatus for effecting material preparation using the crusher as well as to a testing method using the resulting prepared product. More specifically, the invention relates to a crusher to be used for crushing, blending, homogenization and transference of materials; to a process and an apparatus for material preparation using the crusher for processing materials by, for example, crushing, blending, homogenization and transference; to a testing method for analysis, quality assessment, organoleptic testing, observation or recording (in the following, referred to sometimes merely as testing) using the product of the material preparation; and to a process for producing a processed product.

BACKGROUND OF THE INVENTION

In realizing testing for examining a material of, for example, an organism, organic matter or chemical product, for the components, biological or physicochemical properties, particle size, characteristic reaction of a tissue against shearing or crushing or so on of the material using a product of material preparation obtained by shearing or crushing the material, it is necessary to prepare the material in accordance with each specific purpose of examination.

Conventional apparatuses brought into practical use as sample preparation apparatuses for realizing homogenization of materials by shearing or crushing are based on mechanisms for pressing or grinding of the material and for rotating cutter blades. There have been found, as commercial apparatuses, a pressing crusher using a hydraulic press and a crusher using pressing drums in which the material is forced to pass through a narrow interspace between neighboring drums, for those of pressing the material; a wet type Teflon-homogenizer of Potter LBM suited for soft materials, a crusher of a stone-mill type suited for hard material and a crusher of a grinder type, for grinding of the material; and various rotary mills, for rotating of cutter blades.

These conventional apparatuses are suited for crushing specific materials of constant properties, such as hardness, moisture content and so on. Nevertheless, they are poorly suited as an apparatus for shearing, crushing, blending or homogenizing commonly used materials having a hardness, moisture content and so on, which are different from each other, such as agricultural products and foods. Therefore, a large installation or a crusher of complex structure may be required for these common objects with a concomitant shortcoming of greater energy consumption. For example, a pressing crusher, a dry crusher of the stone-mill type, a grinding crusher and a rotary cutter crusher are suitable for crushing materials having a dry tissue, such as seeds of plants, and homogenization can be attained using a blender of varying types after the crushing. Nevertheless, it is difficult to crush soft materials. A wet homogenizer of the Potter LBM type is suitable for grinding and homogenizing soft materials, such as germination tissue of seeds, tissues of roots and so on, but is difficult to crush hard materials.

The preparation products obtained by these crushing/homogenizing apparatuses are present in general in a form of a mixture or fine powder. No apparatus has hitherto been brought into the market, which can separate each selectively classified fraction of each component of the processed material by a minute classification based on the difference in, for example, the particle size or the susceptibility to shearing or crushing, within a single processing work, such as shearing, crushing or sieving.

The conventional apparatuses found in the market are adapted for the cases where the prepared product is nearly the same with respect to the constituent components, composition and so on, as in a factory or laboratory in which relatively sufficient time can be spared for the material preparation. The conventional technique has, however, a difficulty in that too large a time interval is required for performing analysis of the material with pretreatment operation and may not be able to respond to the case of, for example, a wheat harvesting field in which the harvested lots of crop having different moisture contents and different qualities are transported by trucks at an interval of about ten minutes and the quality assessment for each lot by the analysis should be terminated within such an interval. Moreover, conventional apparatuses are large in size and complex in their mechanisms and, therefore, not easy to clean after the processing operation, since disassemblage of the apparatus may be required, so that, in some cases, not removed residues of crop fragments clinging on the inner wall of the apparatus may cause pollution and may bring about a false assessment of the subsequent lots of the crop.

As discussed above, conventional techniques can not attain a continuous material preparation under processing by shearing/crushing and classification within a short period of time with a simple cleaning operation for non-uniform materials having different physicochemical properties with different components and compositions of tissues thereof. No apparatus has hitherto been developed for solving the above technical theme.

SUMMARY OF THE INVENTION

An object of the present invention is to provide a crusher of simple construction, which can process materials easily by shearing, crushing, blending, homogenizing and so on with a lower energy consumption while scarcely suffering from clogging of the apparatus, even for materials having different physicochemical properties with different components and compositions of the tissues thereof.

Another object of the present invention is to provide a process and an apparatus for effecting a material preparation using the above crusher.

A further object of the present invention is to provide a process and an apparatus for effecting a material preparation in which the preparation product prepared as above can be classified.

A still further object of the present invention is to provide a testing method which can serve for a testing, such as a high accuracy analysis, using the preparation product obtained by the above process as the test sample.

A still further object of the present invention is to attain a process for producing processed products, such as foods, industrial articles and others, from the preparation product obtained by the above process.

The present invention consists of the following crusher, process and apparatus embodiments for effecting material preparation and testing method:

A first crusher embodiment comprises:

a first pressing element having a first pressing face provided thereon with protrusions in a form of an isolate island surrounded by depressed marginal spaces, the protrusions being disposed not only in first parallel rows but also in second parallel rows which extend in a direction crossing the first parallel rows, and a second pressing element to be held in engagement with the first pressing element when being pressed thereonto, the second pressing element having a second pressing face provided thereon with protrusions which are disposed in a pattern similar to that of the protrusions of the first pressing element, wherein the protrusions of the first and the second pressing elements are disposed in such a relation that the protrusions of the first or the second pressing element will engage with corresponding depressed marginal spaces on the second or the first pressing face of the second or the first pressing element, respectively, so as to permit crushing of the material supplied to the interspaces therebetween.

The crusher of the first embodiment, wherein the protrusions and the depressed marginal spaces of the first and the second pressing elements are formed in such a manner that first parallel ridges interspaced by first parallel grooves on each pressing element are cut open by second parallel grooves thereon extending in a direction crossing the first parallel grooves.

The crusher of the first embodiment, wherein the first, and the second pressing faces are formed on a plane, curved, arcuate or cylindrical surface.

The crusher of the first embodiment, wherein it comprises a mechanism for moving at least one of the pressing elements so as to move the protrusions of either of the pressing faces relatively to the others, while both the pressing elements are being pressed onto each other.

A crusher of a second embodiment comprises a first rotatable pressing element in a form of a cylinder having a first cylindrical pressing face comprising screw sections disposed at both end regions of the cylinder and a crushing section disposed in the central region of the cylinder, wherein each of the screw sections is furnished with first parallel helical ridges interspaced by corresponding first parallel helical grooves or with second parallel helical ridges interspaced by corresponding second parallel helical grooves, respectively, the first ridges and grooves extending on the cylindrical pressing face in reverse turning sense to the second parallel helical ridges and grooves on the cylindrical pressing face in the other screw section, and wherein the crushing section is provided with protrusions of a form of isolate islands surrounded by depressed marginal spaces, the islands being formed in such a manner that the parallel helical ridges in extension of those on either one of the screw sections are cut by the parallel helical grooves in extension of those on the other one of the screw sections, and a second cylindrical pressing element to be held in engagement with the first pressing element rotatably in counter sense to the rotation of the first pressing element, the second pressing element having a second pressing face comprising screw sections and a crushing section and provided with parallel helical ridges, parallel helical grooves and protrusions disposed in patterns similar to those of the first pressing face of the first pressing element, wherein the ridges and protrusions of the first and the second pressing elements are disposed in such a relation that the ridges and the protrusions on the first or the second pressing element will engage with corresponding grooves and depressed marginal spaces on the second or the first pressing element, respectively, so as to permit crushing of the material supplied to interspaces therebetween.

An apparatus for effecting material preparation, comprising a crusher as defined above.

An apparatus for effecting material preparation, comprising a crusher as defined above, a material port for supplying the material to be processed to the crusher and a classifier for classifying the crushed product from the crusher.

A process for effecting material preparation comprising the steps of supplying the material to be processed to a crusher as defined above and effecting crushing, mixing or homogenization of the so-supplied material by the crusher.

A process for effecting material preparation comprising the steps of supplying the material to be processed to a crusher as defined above, effecting crushing, mixing or homogenization of the so-supplied material by the crusher and classifying the so-processed material.

A preparation product comprising the product resulting from the process defined above.

A testing method using the preparation product as defined above.

A method for producing a processed product using the preparation product as defined above.

DETAILED DESCRIPTION OF THE INVENTION

Figure 1:
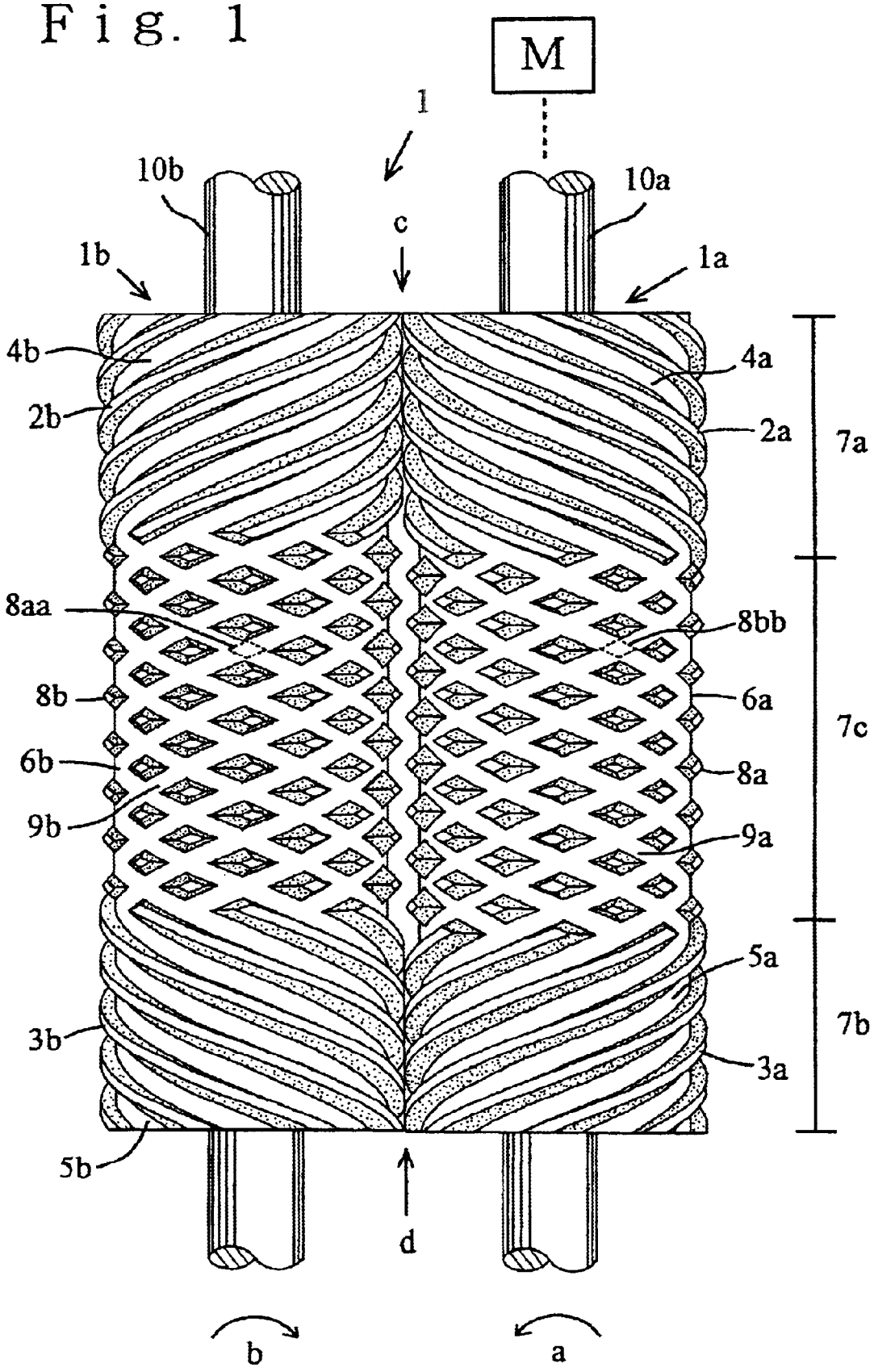
FIG. 1 shows the essential part of an embodiment of the crusher according to the present invention in an explanatory plane view.

In the present invention, the material to be processed is one which can be processed by the crusher by shearing, crushing, blending, homogenizing and so on and organic and inorganic materials and composite materials of them can be dealt with. Specific examples thereof include organisms, foods, agricultural products, medicinal products, chemicals and metals, wherein they may be present in any voluntary form, such as particles and lumps.

The crusher according to the present invention is constructed in such a manner that a first pressing element having a first pressing face is provided thereon with protrusions in a form of an isolate island surrounded by depressed marginal spaces, wherein the protrusions are disposed not only in first parallel rows but also in second parallel rows which extend in a direction crossing the first parallel rows, and a second pressing element is held in engagement with the first pressing element when being pressed thereonto, wherein the second pressing element having a second pressing face is provided thereon with protrusions which are disposed in a pattern similar to that of the protrusions of the first pressing element, wherein the protrusions of the first and the second pressing elements are disposed in such a relation that the protrusions on the first or the second pressing element will engage with corresponding depressed marginal spaces on the second or the first pressing element, respectively, so as to permit crushing of the material supplied to the interspaces therebetween.

The protrusions on the first and the second pressing faces may favorably be formed in such a manner that first parallel ridges interspaced by first parallel grooves on each pressing element are cut by second parallel grooves thereon extending in a direction crossing the first parallel grooves, so that each protrusion is left on the pressing faces in a form of an isolate island surrounded by depressed marginal spaces.

Either one or both of the first and the second pressing faces may be formed on a plane, curved, arcuate or cylindrical surface. For example, it is possible that both the first and the second pressing faces have identical configurations and are found on a plane or cylindrical surface. It is possible also that the first and the second pressing faces each have a configuration different from each other, such that one is a plane face and the other is an arcuate face. For the case where both the pressing faces are formed on a plane surface, the pressing mechanism may preferably be constructed in a reciprocating piston system and, for the case where both are formed on a cylindrical surface, a rotational pressing mechanism may be preferred. When either one of the pressing faces is on a plane surface and the other is on a curved, arcuate or cylindrical surface, a reciprocating or a reciprocally rotatable pressing mechanism may be preferred.

It may be preferable to incorporate a mechanism for moving the protrusions on either one of the pressing faces relative to the protrusions of the other while the pressing elements are held in a state pressed onto each other, though such moving mechanism may be dispensed with in the case of a curved, arcuate or cylindrical pressing element wherein the protrusions are subjected to relative movement to those of the counter pressing element within the depressed marginal spaces of the counter pressing element in accordance with the rotational motion of the pressing element. When one of the paired plane pressing elements is moved along the plane of the pressing face, the crushing efficiency will be increased by an interlocking action between the relatively moving protrusions within the interspaces between the pressing elements.

In the crusher according to the present invention, the material to be processed is supplied to the interspaces between the first and the second pressing faces held confronting to each other so that the protrusions of one pressing face are positioned in the depressed marginal spaces of the other pressing face, whereupon the crushing of the material is effected by pressing the first and the second pressing elements onto each other. When the material to be processed is hard in consistency, crushing of the material may be realized easily by pressing it. When the material to be processed is soft in consistency and is easily extensible, the material will be deformed by pressing and may be embossed by the protrusions. When, in this case, the protrusions of one pressing face are impressed on the counter pressing face at close vicinities of the protrusions of the counter pressing face, the material will be fragmented in a locally cut state. When the protrusions of one pressing face are moved relative to the protrusions of the other pressing face under the state of being impressed on each other, the material can be crushed in a partially fragmented state. When at least one of the pressing elements is subjected to a rotational movement, a similar effect of partial fragmentation may be realized, since the protrusions will perform relative movement within the depressed marginal spaces of the counter pressing element by the rotational motion.

It is favorable that the depressed marginal spaces around the protrusions are formed so as to be offset aside the protrusions of the confronting counter pressing face, namely, at crossing portions of the first and the second grooves extending in directions crossing each other on the pressing face. By arranging the protrusions at such portions, the mass of the material found on the protrusions within the interspaces between the pressing faces will be displaced aside the protrusions to the depressed marginal spaces surrounding them upon impression of the confronting pressing elements onto each other to attain crushing of the material, since the protrusions of one pressing face are offset to those of the other pressing face, whereby the crushing can be realized at a lower friction with low heat evolution and lower energy consumption.

THE BEST MODE FOR EMBODYING THE INVENTION

Below, the description is directed to a preferred embodiment of the crusher according to the present invention.

A preferred embodiment of the crusher according to the present invention comprises a first rotatable cylindrical pressing element and a second rotatable cylindrical pressing element and is constructed such that the first pressing element has a first cylindrical pressing face comprising screw sections disposed at both end regions of the cylinder and a crushing section disposed in the central region of the cylinder, wherein each of the screw sections is furnished with first parallel helical ridges interspaced by corresponding first parallel helical grooves or with second parallel helical ridges interspaced by corresponding second parallel helical grooves, respectively, the first and second ridges and grooves extending along a helix on the cylinder in reverse turning sense to the corresponding helix of each of the corresponding parallel helical ridges and grooves on the other screw section, respectively, in a mirror-symmetrical relation, and the crushing section is provided with protrusions of a form of isolate islands surrounded by depressed marginal spaces, the islands being formed in such a manner that the parallel helical ridges in extension of those on either one of the screw sections are cut by the parallel helical grooves in extension of those on the other one of the screw sections, and the second pressing element is held in engagement with the first pressing element rotatably in counter sense to the rotation of the first pressing element, which second pressing element has a second pressing face comprising screw sections and a crushing section and provided with parallel helical ridges, parallel helical grooves and protrusions disposed in patterns similar to those of the first pressing face of the first pressing element, wherein the first and second pressing elements are held in engagement with each other in such a relationship that the ridges and the protrusions on the first or the second pressing element will engage with corresponding grooves and the depressed marginal spaces on the second or the first pressing element, respectively, so as to permit crushing of the material guided to the crushing section.

Such a crusher has a construction similar to a coupled pair of double helical gears disposed side by side under engagement of their double helical teeth with each other, wherein each double helical gear, to serve as one of the pressing elements, has a structure in which two mirror-symmetrical halves of a helical gear with helical teeth of reverse helical turning sense are joined in axial abutment, with the helical grooves interspacing the teeth for both halves in the adjoining central portion being extended further to leave cut protrusions. In both end portions of the double helical gear, the helical teeth in reverse helical turning sense are left in a form of a screw to build up a first and second screw sections, respectively, in which the screw thread is held gearingly with the corresponding helical grooves interspacing the teeth of the coupled counter double helical gear, so that the screw sections can transmit torsional driving motion and guide the material to be processed towards the central portion of the double helical gear but hardly crushes the material. In the central portion of the double helical gear, the parallel helical ridges of the teeth in extension of those on either one of the screw sections are cut by the parallel helical grooves between the teeth in extension of those on the other one of the screw sections to leave cut protrusions of a form of isolate square conical or truncated square conical islands surrounded by depressed marginal spaces. At the positions in the central portion at which the helical ridges of the teeth of one helical gear are intersected by the parallel helical grooves between the teeth of the other helical gear, protrusions are left from the ridges by being cut by the grooves in a form surrounded by depressed marginal spaces formed by the grooves. The material to be processed is held in this central portion (referred to in the following as crushing section) within these depressed marginal spaces so as to be subjected to the processing actions, such as shearing, crushing, blending, homogenization and transference.

In the above-described crusher, the rotary shafts are supported rotatably on bearings in the state in which the first and the second pressing elements are held under engagement with each other. The rotary shaft of one of the pressing elements, for example, the first pressing element, is coupled with a driving shaft connected to a driving source (electric motor). By driving the driving shaft, the driving power is transmitted via the driving pressing element (the first pressing element) to the driven pressing element (the second pressing element) to cause them to rate in a counter rotational sense, since the screw threads, i.e. the ridges of the teeth, of one pressing element in the screw sections are held gearingly with the corresponding grooves of the other pressing element therein. When the material to be processed is supplied to the rotating crusher via a material supply port, the material may not substantially migrate across the ridges of the screws due to interception by the gearing of the ridges with the grooves of the counter element but is guided towards the central section, i.e. crushing section, of the pressing elements by the conveying action by the rotated screws. In the crushing section, the material supplied is held in the depressed marginal spaces around the protrusions and is subjected to actions of shearing and rotation by the movement of the protrusions intruding and receding into and out of the depressed marginal spaces of the counter element caused by the rotation of the rotary shafts. During rotation of the elements, the protrusions perform an angular motion within the depressed marginal spaces, whereby the material found therein is subjected to actions of pressing, shearing friction and crushing so that it is processed by shearing, crushing and blending to attain homogenization, while being transferred through the interspaces between the first and the second pressing elements.

The sectional configuration of the ridges or screw threads of the pressing elements may favorably be such that a sharp knife edge is formed at the periphery thereof in order to make it possible to process materials of a viscoelastic nature by shearing, as in the case of a cutter blade. For easily fragmented materials, however, it is possible that an angular corner is formed on the ridges, as in a commonly used roll crusher. It is favorable that the pressing elements are rotatable in such a condition of engagement that the ridge will be brought into contact with the face of the confronting groove of the corner element at least at one point, preferably at a position of its peripheral edge, during one full turn of revolution, whereby the apparatus can be constructed so that the material may not migrate across the ridges in the screw sections but is guided towards the crushing section, where it is sheared and crushed before passing through the interspaces between the pressing elements. In the case of a rough crushing, it is of course possible to construct the apparatus so that the pressing elements are arranged so as to leave a free gap between the pressing elements, wherein it is possible to provide a driving power transmitting means between the rotary shafts of the pressing elements.

The pressing elements may be made of a hard material, such as a super hard alloy or a ceramic, while plastic resins may be used for the pressing elements for processing soft materials. Stainless steels may favorably be used for metal pressing elements, wherein it is preferable to use a ferromagnetic steel, such as SUS 403, for the material of the pressing element and to provide a magnet, such as a rare earth metal magnet, within a product chamber for the material preparation product, in order to remove split or cracked fragments of the metal to prevent contamination of the product by the metal fragments. While the size of the pressing elements may be determined in accordance with each specific material to be processed and with the contemplated purpose, the pressing element may favorably be designed for producing a preparation product of, for example, wheat for use as a testing sample, in such a manner that it has a tip diameter, namely, the diameter of the tip circle of the helical ridges of the pressing element, in the range from 10 to 40 mm, preferably from 20 to 30 mm, and a module in the range from 1 to 1.5 mm. The helical angle of the helical ridge, namely, the angle of inclination of a tangent of the helix against a plane vertical to the helix axis, may favorably be in the range from 15° to 60°, preferably from 15° to 30°, for guiding the material effectively. The cylindrical pressing elements may be arranged not only in a pair but also in a combination of three or more elements under engagement with each other. While the crusher may be installed as a single stage, it may be arranged as a plurality of stages for repeating and shearing, crushing, blending or homogenization in the plural stages. The crusher may be operated in a gaseous medium, such as air, or in a liquid medium. In the case of the former, it is favorable that the shaft of the cylindrical rotatable pressing element be designed as a hollow shaft to circulate therethrough a coolant for effecting cooling of the elements. In the case of the latter, an agitational action due to convection may also be imparted to the material to be processed. The number of revolution of the pressing elements may be chosen depending on, for example, the size thereof, specific sort of material to be processed and specific purpose of the material preparation, while a preferable embodiment of, for example, preparation of a test sample for wheat may employ a revolution rate in the range from 30 to 600 r.p.m., preferably from 60 to 200 r.p.m.

The apparatus for the material preparation according to the present invention using a crusher as described above may be furnished with a material supply passage at a portion above or beside the crusher for supplying the material to be processed to the apparatus. The supply passage may be disposed above the crushing section of the pressing elements of the horizontally disposed crusher, while it may also be arranged adjacent to one screw section, to thereby effect guiding of the material in this screw section towards the crushing section where the material is subjected to the action of shearing, crushing, blending, homogenization or the like, whereby the processed preparation product is obtained.

The crusher is disposed in a horizontal posture and the material to be processed is supplied thereto by the gravity in a dry process while rotating the pressing elements in a reverse direction to each other so as to draw the material into the interspaces between them, namely, downwards from above on the confronting sides thereof. In a wet process in, for example, an aqueous medium, repetition of swinging rotations of the pressing elements in reverse sense turnings to each other may cause an increase in the efficiency of shearing, crushing or homogenization of the material due to the occurrence of complex convections of the liquid medium in up-and-down directions.

Materials exhibiting higher tenacities, such as glutinous wheat and plastic resins, may be processed at low temperature by a concomitant use of, for example, liquid air, ice or granular dry ice, wherein the shearing can be attained effectively due to the solidification of the tenacious materials. When separation or classification of ingredients of the material, such as powdery endosperm and bran of wheat, powdery ingredients of iron, aluminum and plastic resin of a composite material and so on, in a classifier based on the difference of properties, such as volume and specific weight, the efficiency of separation may be increased by operating the crusher while holding the material preparation apparatus in an inclined posture with its side of floating material exit port being held in a lower level, whereby the lighter ingredients, such as the bran of wheat or powdery aluminum and resin of the composite material, may be permitted to discharge out of the apparatus via the floating material exit port by floating up on the moving particle layer and flooding over a sifting bank disposed at the end on the side of the exit port of the classifier arranged in a form encasing the crusher to thereby cause them to be guided to the exit port.

A similar separation effect may be attained by designing the classifier to have a greater inner diameter towards the floating material exit port side. Here, the material to be processed or the rest of the preparation product is guided by the helical ridges on the pressing faces in the screw sections of the pressing elements towards the central section (crushing section), where it is processed into disintegrated product which is guided into the surrounding classifier having a greater inner diameter towards the exit port side, wherein the lighter ingredients travel over a longer path due to the gradually increasing passage gap, so that the lighter ingredients, such as bran in the case of sifting of crushed wheat, will flood over the sifting bank and can be removed. The not sifted coarse remainder will be returned to the material supply port and, then, to the crushing section by a principle similar to a rotating water wheel, whereby they are subjected to repeated processings by shearing and crushing.

By the apparatus for effecting material preparation according to the present invention, the material to be processed is subjected to the actions of shearing and crushing in the crushing section of the crusher having a structure similar to a double helical gear by being guided by the helical ridges thereof from the screw sections disposed on both end portions of each of the pressing elements held in engagement with each other towards the central crushing section thereof, where it is subjected to the actions of shearing and crushing while preventing intrusion of the finely disintegrated preparation product into the gap between the helical ridges and the inside face of a shield for the pressing elements in the screw section to cause clogging of the crusher, whereby the throughput of the crusher can be increased while preventing pollution of the preparation product and, in addition, material preparation in a quite minute amount of, for example, several tens of milligrams of the material can be realized. Moreover, the crusher having cylindrical pressing elements, which are held under engagement with each other in such a relationship that the protrusions of either one of the pressing elements will engage with corresponding depressed marginal spaces on the pressing face of either one of the pressing elements so as to permit crushing of the material supplied to the interspaces therebetween, has a broad area of engagement of the helical ridges with each other, so that occurrence of displacement in the engagement due to dislocational counteraction can be prevented, even upon shearing or crushing of a hard material, such as dry seed, whereby processing of large amounts of material can be realized at a high speed. A material revealing a high tenacity or glutinosity, such as glutinous rice or the like, can be sheared or crushed efficiently by the crusher by designing the helical ridges in the screw sections to have lower thickness with sharp tips in order to increase the shearing strength and in order to reduce simultaneously the pressing stress to thereby prevent thermal metamorphic change by gelatinization of the starch by the action of pressure into a glutinous state.

The preparation product can be used as such for practical use, while it is permissible to install a classifier, such as a sieve, when classification is required. For separating only two components, such as bran and powder of wheat, use of one single sieve screen may be enough, while a plurality of sieve units with different screen meshes are used for classifying into three or more fractions of different particle sizes. The sieve may be designed in a cylindrical form, in order to arrange one or more sieves radially outside the crusher and to effect sifting of material by rotating them by making use of the rotational driving means of the crusher to realize the sifting or classification of the material continuously. On using a plurality of sifting units with different screen meshes, it is permissible to dispose them either in a row in a radial direction or side by side on a cylindrical plane surrounding the crusher with the sieve retention face inwards. In the case of the latter, a continuous classification can be attained by an arrangement of closure means. By the use of a plurality of sifting units with different screen meshes, the sheared and crushed product can be classified in accordance with the particle size into fractions with different average particle sizes. When a plurality of sifting units are disposed side by side on a cylindrical plane and the so-disposed sifting arrangement is caused to rotate, the sifting remainder retained on each screen of the sifting units are returned to the crusher to be subjected to the shearing and crushing actions repeatedly by a principle similar to a rotating water wheel, whereby a large amount of preparation product can be produced efficiently. By actuating the closure means, which are each disposed so as to cover each of the inside openings of the sifting units arranged on a cylindrical surface surrounding the crusher, to open or close selectively in a controlled manner, the sifting operation of each sifting unit can be realized in a temporarily shifted phase, whereby, for example, a particulate fraction composed mainly of a plant tissue subject to easy pulverization into fine powder can be separated from those which can only be pulverized after a prolonged and repeated processing by shearing and crushing.

By using a classifier in which cylindrical sifting units are arranged so as to be aligned in one or more radial rows, each in the order of fineness of the screen mesh from outside to inside, an efficient classification of sheared and crushed powdery product can be realized on a wider sifting area. A classifier having sifting units arranged in a plurality of radial rows surrounding the crusher can produce classified products having average particle sizes ranging from the finest one from the outermost sifting unit to the coarsest one from the innermost sifting unit.

The preparation product obtained in the manner as above can serve for practical uses either as obtained or in a form of a composite blend with other ingredient(s) for, for example, foods, medicinal products, chemical products and products for mining and industrial applications. For example, in the case of the milling industry, the preparation product obtained as above can be used as such for dietary and other applications. The classified preparation products may be used individually in accordance with the particle size or be used integrally for a specific purpose. It is possible to produce products for, for example, nutrient, medicinal, chemical and industrial applications, using the preparation products as the raw materials.

The testing method according to the present invention is applicable to testing for analysis and so on by using the preparation product obtained as above for the testing sample.

The materials to be subjected to the testing method according to the present invention are tested for, for example, quality assessment, analysis and observation. Such materials include organisms, organic materials and chemical substances. Specific examples encompass starches of seeds, tissues of animals (including human) and plants, minerals and metals.

The testing method in quality assessment, analysis or observation using such a preparation product can be applied for every technique for performing an analysis, observation, determination, recording and so on, which uses the preparation product obtained by shearing and crushing the material to be processed as obtained, a pelletized product obtained by compacting the preparation product or a homogenate obtained by subjecting the material to be processed to actions of shearing and crushing in a liquid medium to disperse and solubilize it. It includes, for example, analysis techniques employing arithmometry, such as spectroanalyses using electromagnetic waves (including those using visual rays, IR rays, UV rays, Raman rays, fluorescent rays and fluorescent X-rays and color-difference meter), mass-spectroanalyses and material property tests; chemical analyses using liquid chromatography and dry chemistry; biological tests; and testing methods by means of observation, determination and recording of images, such as by television, image analysis devices, photography and visual assessments.

Using a test sample obtained by crushing, blending or homogenizing efficiently as the preparation product obtained as above, high accuracy testings can be realized.

Using the preparation product obtained especially after classifying by a classifier as the test sample, assessments of pharmacological and physicochemical properties, analysis and so on of a food product, medicinal product or so on can be realized at a high accuracy, since the processed product containing, for example, a plant tissue, obtained under an accurate classification in the classifier retains original physicochemical properties inherited from the original plant tissue. When the technique according to the present invention is applied to production of processed marine products or the like, hard tissues, such as those in fish heads, etc., rich in eicosapentaenoic acid, collagen and so on, can be rendered edible so that an increase in the nutrient value can be attained.

As described above, the crusher according to the present invention has a simple construction and can be utilized as a machine which is operative in an atmospheric condition or in a liquid medium easily for shearing, crushing, blending, homogenization and so on of materials to be processed, at a low energy consumption without suffering from clogging of the crusher, even for materials having components, compositions and physicochemical properties different from each other.

By the process and the apparatus for effecting material preparation according to the present invention, even materials having moisture contents and characteristic properties different from each other can be processed easily and efficiently by crushing, blending and homogenization using the crusher.

The apparatus for effecting material preparation comprising cylindrical pressing elements according to the present invention permits miniaturization of the apparatus, reduction of energy consumption, prevention of heat evolution and increase in the speed of material preparation, since the apparatus is designed so that the material to be processed is guided by the pressing elements having screw sections acting in a manner of a screw conveyer towards the central crushing section, where it is processed by shearing, crushing, blending and homogenization together with re-processing of the processing residues in one single process step without having any influence by the hardness, components, composition and so on of the material to be processed. Due to the characteristic feature that the material is processed by being guided to the central crushing section, the apparatus does not suffer from contamination of the preparation product caused from clogging of the apparatus by the processed pulverous product due to accumulation thereof in the gap between the crusher and the support block, so that an increase in the purity of the preparation product can be attained together with permission of a small amount of material to be processed.

When a classifier comprising a plurality of sifting units having different sifting screen meshes and provided with closure means is employed, classified fractions as the final products can be obtained by performing the classification based on the difference in, for example, the easiness of crushing, particle size or so on. The accuracy in the testing, such as spectroanalysis and biochemical analysis, can therefore be increased, which may be effective for producing processed products in which such a characteristic feature is adopted.

By the testing method according to the present invention, various tests can be performed at a high accuracy using each test sample which is produced easily and efficiently, even for materials having components, compositions and characteristic properties different from each other.

By the method for producing a processed product according to the present invention, processed products of voluntary forms and consistencies, including that in a state of being partly cut and crushed, that in a completely crushed state and composite products with other constituent material(s), can be produced.

Below, the present invention will further be described by way of embodiments.

An embodiment of the crusher according to the present invention is shown in FIG. 1 in an explanatory plane view. The crusher 1 has a construction in which a first cylindrical pressing element 1*a* and a second cylindrical pressing element 1*b* are held in engagement with each other, wherein the state of engagement of the two elements is illustrated somewhat apart from each other for the sake of easy understanding (the same applies to FIGS. 2 and 4). The first and the second pressing elements 1*a* and 1*b* are arranged in such a construction that the first rotatable pressing element 1*a* in a form of a cylinder has a first cylindrical pressing face 6*a* comprising screw sections 7*a* and 7*b* disposed at both end regions of the cylinder and a crushing section 7*c* disposed in the central region of the cylinder, wherein each of the screw sections 7*a*, 7*b* is furnished with first parallel helical ridges 2*a* interspaced by corresponding first parallel helical grooves 4*a* or with second parallel helical ridges 3*a* interspaced by corresponding second parallel helical grooves 5*a*, respectively. The first ridges 2*a* and grooves 4*a* in the first screw section 7*a* extend along a helix on the cylinder in a reverse turning sense to each corresponding helix of corresponding second parallel helical ridges 3*a* and grooves 5*a* in the second screw section 7*b*, respectively, in a mirror symmetrical relationship, and wherein the pressing faces 6*a*, 6*b* in the crushing section 7*c* are provided with protrusions 8*a* or 8*b* of a form of isolate islands surrounded by depressed marginal spaces 9*a* or 9*b*, which islands are formed in such a manner that the parallel helical ridges (2*a*, 2*b*, 3*a*, 3*b*) in extension of those on either one of the screw sections (7*a*, 7*b*) are cut by the parallel helical grooves (4*a*, 4*b*, 5*a*, 5*b*) in extension of those on the other one of the screw sections. The second cylindrical pressing element 1*b* is held under engagement with the first pressing element 1*a* rotatably in counter sense to the rotation of the first pressing element 1*a*, which second pressing element 1*b* has a second pressing face 6*b* comprising screw sections 7*a*, 7*b* and a crushing section 7*c* and provided with parallel ridges (2*b*, 3*b*), parallel grooves (4*b*, 5*b*) and protrusions (8*b*) disposed in patterns similar to those on the first pressing element 1*a*, wherein the first and the second pressing elements are held in engagement with each other in such a relation that the ridges (2*a*, 3*a* or 2*b*, 3*b*) and the protrusions (8*a* or 8*b*) of the first or the second pressing element (1*a* or 1*b*) will engage with corresponding grooves (4*b*, 5*b* or 4*a*, 5*a*) and the depressed marginal spaces (9*b* or 9*a*) on the second or the first pressing element (1*b* or 1*a*), respectively, so as to permit crushing of the material guided to the crushing section 7*c*.

Such a crusher 1 has a construction similar to a coupled pair of double helical gears disposed side by side under engagement of their double helical teeth with each other, wherein each double helical gear, to serve as one of the pressing elements, has a structure in which two mirror-symmetrical halves of a helical gear with helical teeth of a reverse helical turning sense are joined in axial abutment, with the helical grooves interspacing the teeth for both halves in the adjoining central portion being extended further to leave cut protrusions. In both end portions of the double helical gear, the helical teeth in reverse helical turning sense are left in a form of a screw to build up first and second screw sections, respectively, in which the screw thread is held gearingly with the corresponding helical grooves interspacing the teeth of the coupled counter double helical gear, so that the screw sections can transmit torsional driving motion and guide the material to be processed towards the central portion of the double helical gear but hardly crushes the material. In the crushing section 7*c*, the first and the second parallel helical ridges (2*a*, 2*b*, 3*a*, 3*b*) in extension of those on either one of the screw sections (7*a* or 7*b*) are cut by the parallel helical grooves (5*a*, 5*b*, 4*a*, 4*b*) in extension of those on the other one of the screw sections (7*b* or 7*a*) to leave cut protrusions (8*a*, 8*b*) of a form of isolate square conical or truncated square conical islands surrounded by depressed marginal spaces (9*b* or 9*a*). At the positions in the crushing section at which the helical ridges (2*a*, 2*b* or 3*a*, 3*b*) of one pressing element (1*a* or 1*b*), are intersected by the parallel helical grooves (5*a*, 5*b* or 4*a*, 4*b*) of the other pressing element (1*b* or 1*a*), protrusions (8*a* or 8*b*) are left from the ridges (2*a*, 2*b* or 3*a*, 3*b*) by being cut by the grooves in a form surrounded by depressed marginal spaces (9*a*, 9*b*) formed by the grooves in such a relation that the protrusions (8*a* or 8*b*) intrude into a part of the depressed marginal spaces of the counter pressing element, namely, at the position where the first and the second grooves are crossing. The material to be processed is held in this crushing section within these depressed marginal spaces (9*a*, 9*b*) so as to be subjected to the processing actions of shearing, crushing, blending, homogenization and transference.

In the above-described crusher 1, the rotary shafts 10*a* and 10*b* are supported rotatably on bearings in the state in which the first and the second pressing elements 1*a* and 1*b* are held under engagement with each other. The rotary shaft (10*a* or 10*b*) of one of the pressing elements, for example, the first pressing element 1*a*, is used as the driving shaft connected to a driving source M (electric motor). By driving the driving shaft, the driving power is transmitted via the driving pressing element (the first pressing element 1*a*) to the driven pressing element (the second pressing element 1*b*) to cause them to rotate in counter rotational sense, as shown by the arrows a and b, since the screw threads, i.e. the ridges (2*a*, 3*a* or 2*b*, 3*b*) of one pressing element (1*a* or 1*b*) are held gearingly with the corresponding grooves (4*b*, 5*b* or 4*a*, 5*a*) of the other pressing element (1*b* or 1*a*) therein. When the material to be processed is supplied to the rotating crusher 1 via a material supply passage 19 (FIG. 2), the material may not substantially migrate across the ridges (2*a*, 3*a*, 2*b*, 3*b*) on the pressing elements (1*a*, 1*b*) due to interception by the gearing of these ridges with corresponding grooves (4*b*, 5*b* or 4*a*, 5*a*) of the counter element but is guided along the ridges towards the crushing section 7*c*, as shown by the arrows c and d, by the conveying action by the rotated parallel helical ridges. In the crushing section 7*c*, the material supplied is held in the depressed marginal spaces 9*a*, 9*b* around the protrusions 8*a*, 8*b* and is subjected to actions of shearing and rotation by the movement of the protrusions 8*a*, 8*b* intruding and receding into and out of the depressed marginal spaces 9*b*, 9*a* of the counter element caused by the rotation of the rotary shafts 10*a*, 10*b*. During rotation of the elements 1*a*, 1*b*, the protrusions 8*a*, 8*b* perform an angular motion within the depressed marginal spaces 9*b*, 9*a*, whereby the material found therein is subjected to actions of pressing, shearing friction and crushing so that it is processed by shearing, crushing and blending to attain homogenization, while being transferred through the interspaces between the first and the second pressing elements 1*a* and 1*b*.

Figure 2:
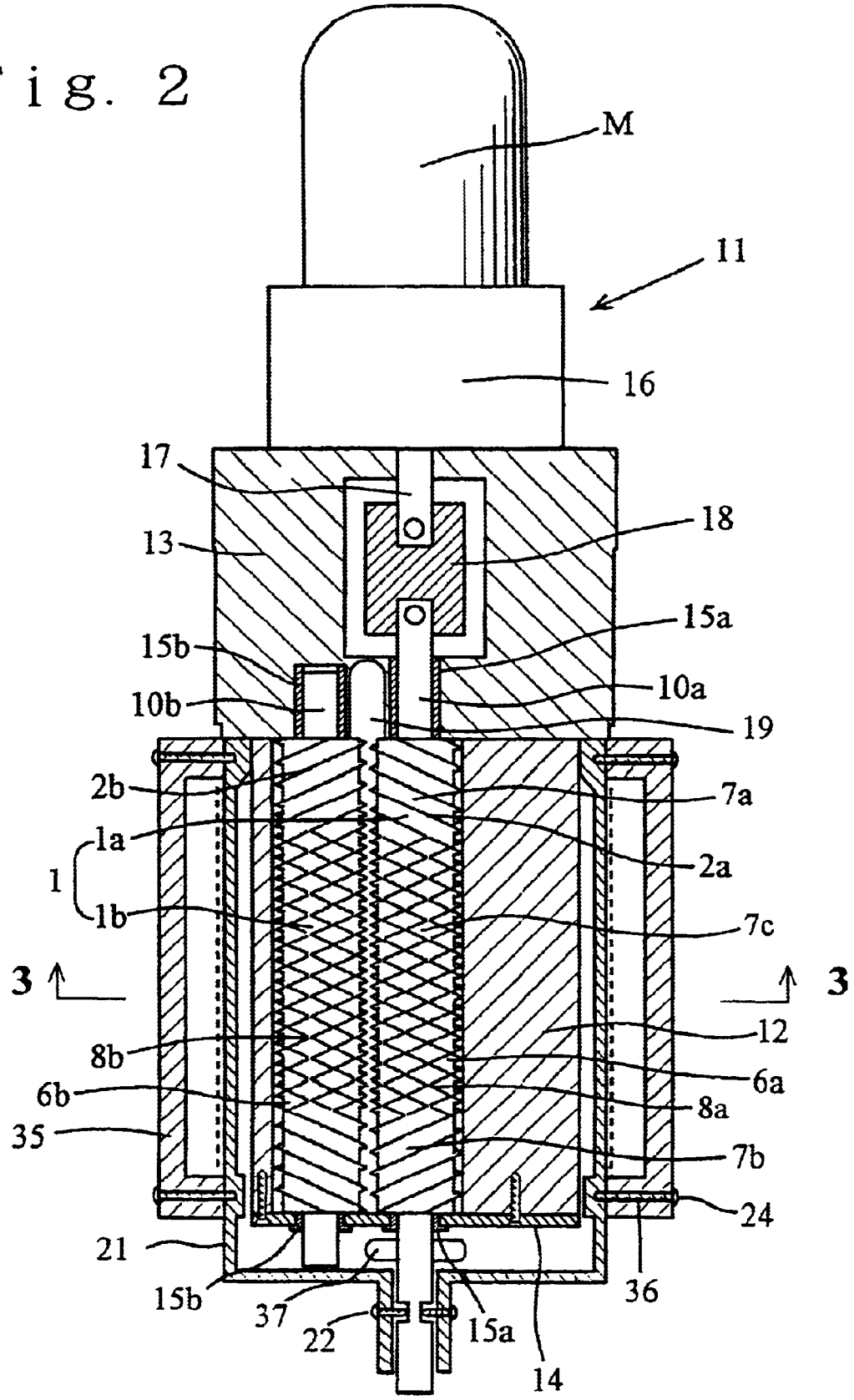
FIG. 2 shows an embodiment of the apparatus for material preparation according to the present invention in a horizontal sectional view.
Figure 3:
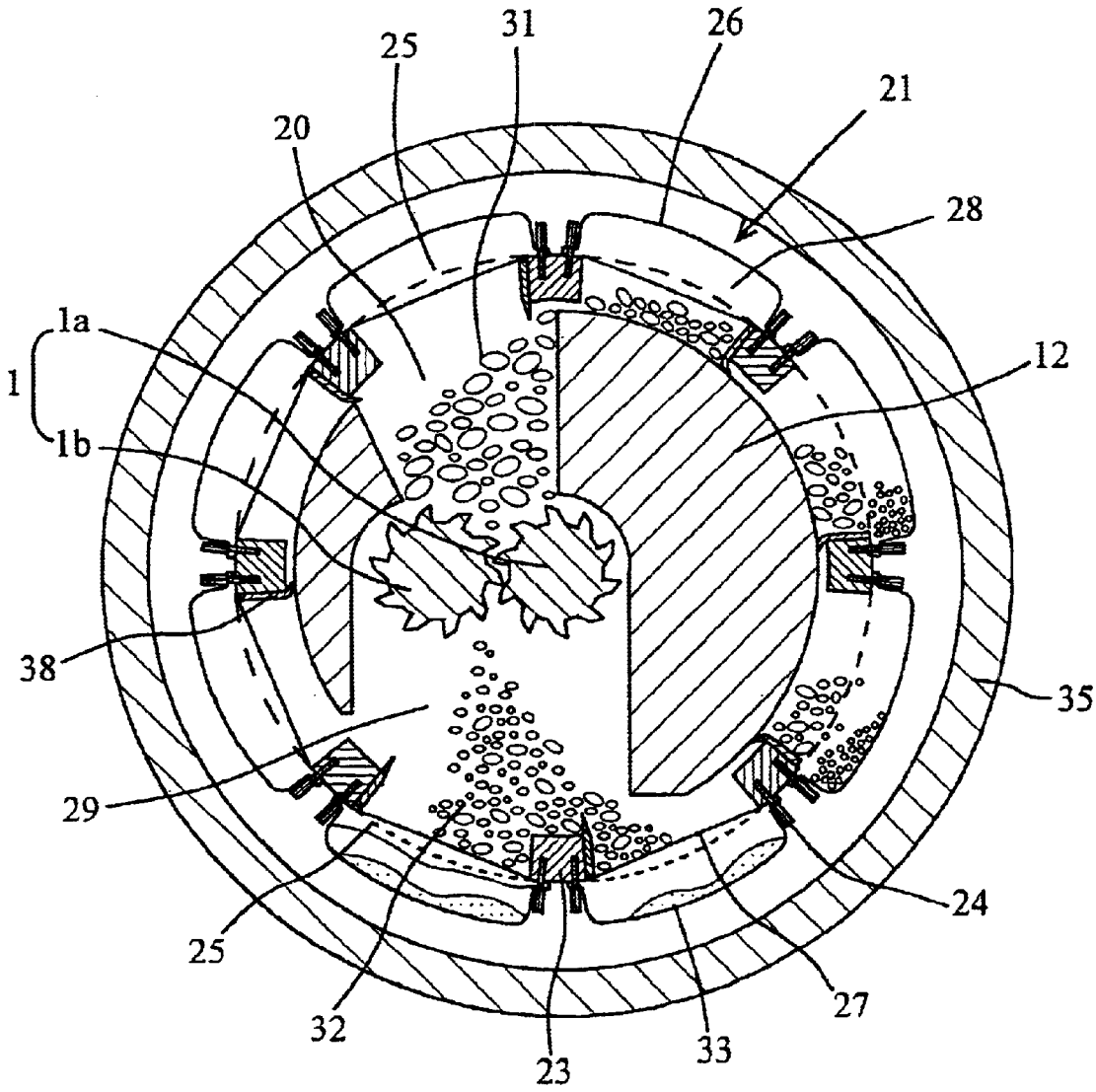
FIG. 3 is a section in the plane along the line 3—3 in FIG. 1

An embodiment of the apparatus for material preparation according to the present invention is shown in FIG. 2 in a horizontal sectional view with its section along the line 3—3 being shown in FIG. 3. The apparatus for material preparation 11 comprises a crusher 1 comprising first and second pressing elements 1*a* and 1*b* mounted rotatably on support elements 13 and 14 under rotatable bearing support of the rotary shafts 10*a* and 10*b* by bearings 15*a* and 15*b* disposed at both ends of a shield member 12 shielding the pressing elements. The rotary shaft 10*a* is coupled at its end on the side of the support element 13 with a driving shaft 17 extending from an electric motor M under intermediation by a reduction gear 16 by means of a coupling 18. A material supply passage 19 is disposed at a lower position of the support element 13 so as to communicate with a material port 20 disposed at an upper position of the crusher 1. The driving shaft 10*a* carries a classifier 21 by being coupled therewith at a portion of its end on the side of the support element 14 by means of fixing members 22 so as to hold the classifier in rotation together with the pressing element 1*a*. The classifier is constructed in such a manner that a plurality of sifting units 28, each having a screen 25 of varying screen mesh fixed by fixing members 24 on a frame 23 of a form of a cage, a collector pan 26 and a closure means 27, are arranged side by side on a circumferential cylindrical plane surrounding the driving shaft 10*a*. An enclosure jacket 35 is provided so as to cover the classifier 21 over its circumference under fixation by fixing members 36, 37 is a floating material exit port and 38 denotes scrapers.

When the driving device M is actuated to rotate the driving shaft 17 of the apparatus for material preparation described above, the rotational torque is transmitted to the pressing elements 1*a* and 1*b* held in engagement with each other to cause them to rotate in counter rotational sense, as explained above with reference to FIG. 1. On supplying the material 31 to be processed to the apparatus via the material supply passage 19, the material 31 enters first the material port 20, from which it is guided by the ridges 2*a* and 2*b* of the pressing elements in their screw section 7*a* towards the crushing section 7*c* due to rotation of the pressing elements 1*a* and 1*b*. Therefore, no clogging of the apparatus occurs due to stuffing of the interspaces between the shield element 12 and the pressing elements 1*a*, 1*b* with the material 31 so that there is no fear of interruption and trouble of operation. The material 31 reaching the portion above the crushing section 7*c* will be drawn into the interspaces between the pressing elements 1*a* and 1*b* by the rotation of the protrusions 8*a* and 8*b* to thereby be subjected to the processing actions by shearing, crushing, blending, homogenization and so on, before it is transferred to a product chamber 29 as the crushed crude product 32.

The classifier 21 is held in rotation in synchronism with the rotation of the pressing element 1*a* to effect sifting of the crushed crude product 32 in the product chamber 29 to obtain classified product 33. When a plurality of sifting units having different screen meshes are used, classification of the crude product into corresponding plural classified products of corresponding average particle sizes can be attained by operating the closure means 27 on the sifting units 28 to open in the sequence corresponding to the order to mesh size of the sifting screen 25. Such classified preparation products may be used, for example, for assessing the characteristic properties in accordance with the particle size. In the case of flour milling of a cereal by sifting the crushed crude product with a single screen mesh size to separate the powdered product from the refuse (such as bran of wheat), the above apparatus may be employed with all the closure means 27 held open.

Figure 4:
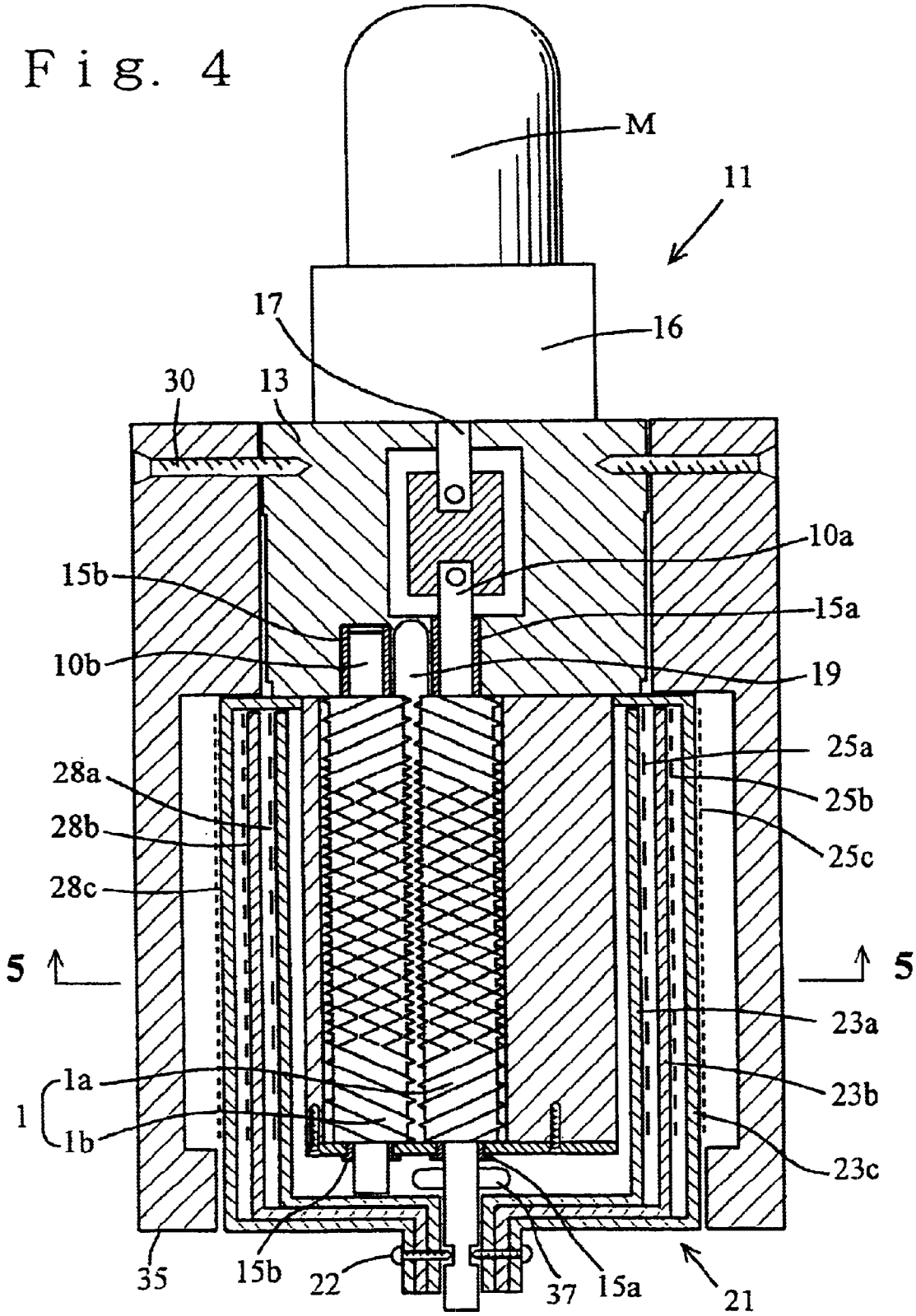
FIG. 4 shows another embodiment of the apparatus for material preparation according to the present invention in a horizontal sectional view.
Figure 5:
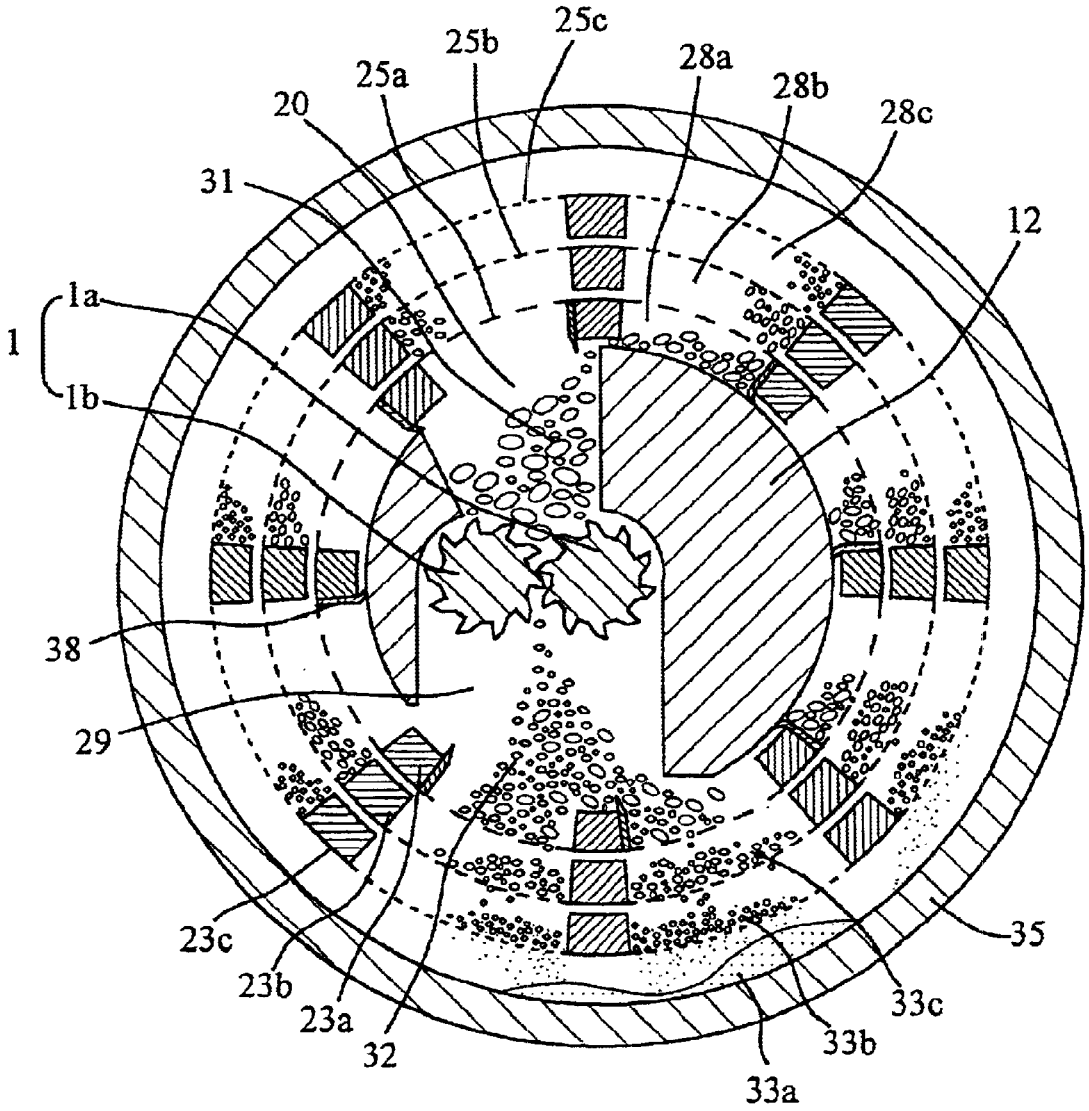
FIG. 5 is a section in the plane along the line 5—5 in FIG. 3.

FIG. 4 shows another embodiment of the apparatus for material preparation in a horizontal sectional view, wherein the section along the line 5—5 thereof is given in FIG. 5. In this embodiment, a classifier 21 is employed, wherein a plurality of sifting units 28*a*, 28*b* and 28*c* are installed by being fixed onto the rotary shaft 10*a* by fixing member 22 so as to build up an integrated arrangement of such a construction, that screens 25*a*, 25*b* and 25*c* of different mesh sizes are mounted on a frame 23*a*, 23*b* or 23*c* of a form of cage one over another in the order of mesh size from largest outermost one to the smallest innermost one at an interval so as to align each corresponding screen on the same coaxial cylindrical face. Surrounding the classifier 21, an enclosure jacket 35 is provided by being fixed onto the support element 13 by fixing members 36. Other constructions are substantially the same as in those shown FIGS. 2 and 3.

In the apparatus described above, the material preparation is performed in a similar manner as in the apparatus shown in FIGS. 2 and 3. The resulting preparation product 32 is taken out of the apparatus as classified fractions by being guided from the crushed crude product chamber 29 to the rotating sifting units 28 to effect sifting by the sifting screens 25*a*, 25*b* and 25*c* arranged in the successively decreasing order of screen mesh size.

Figure 6:
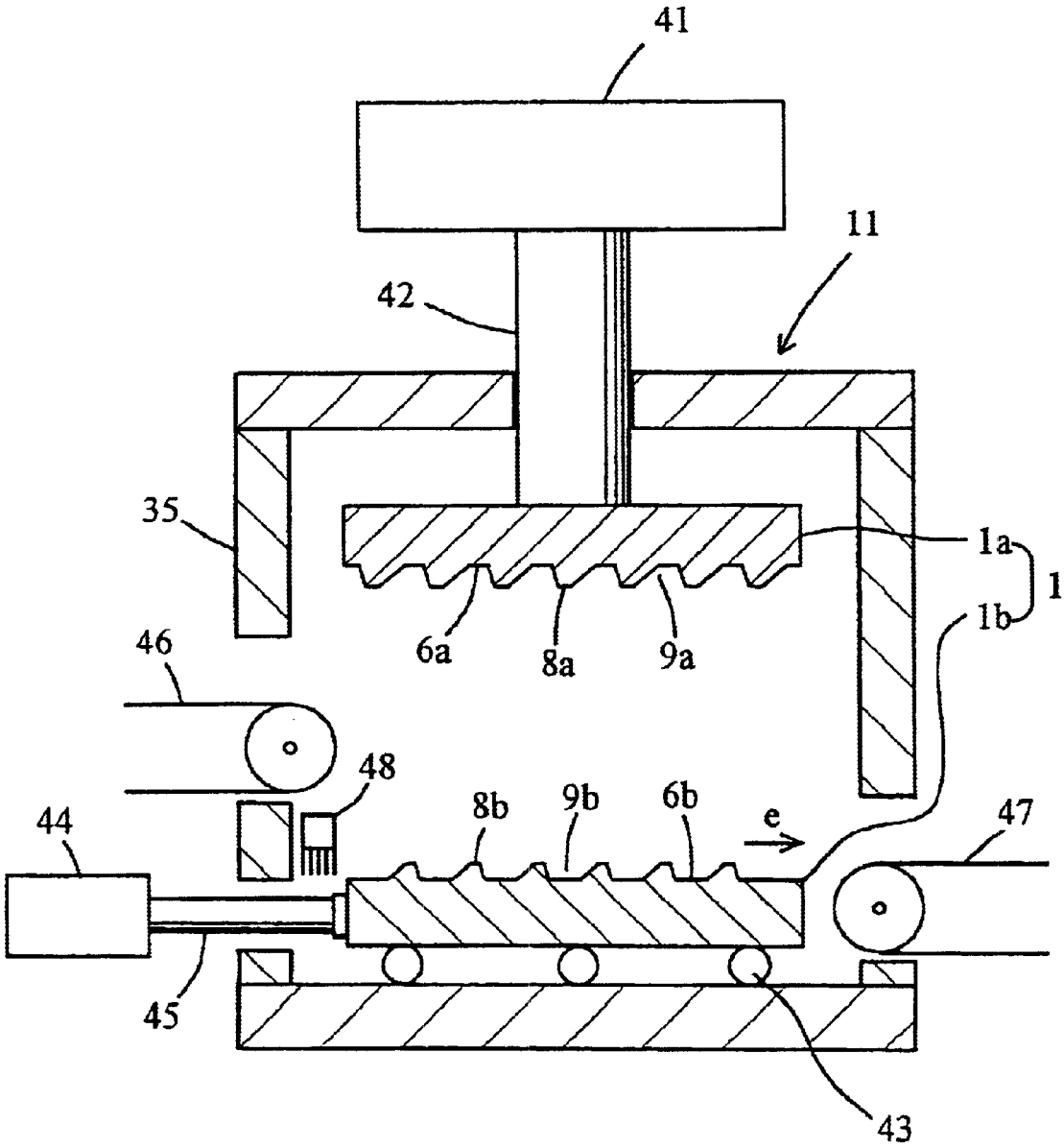
FIG. 6 shows a further embodiment of the apparatus for material preparation according to the present invention in a vertical sectional view.
Figure 7:
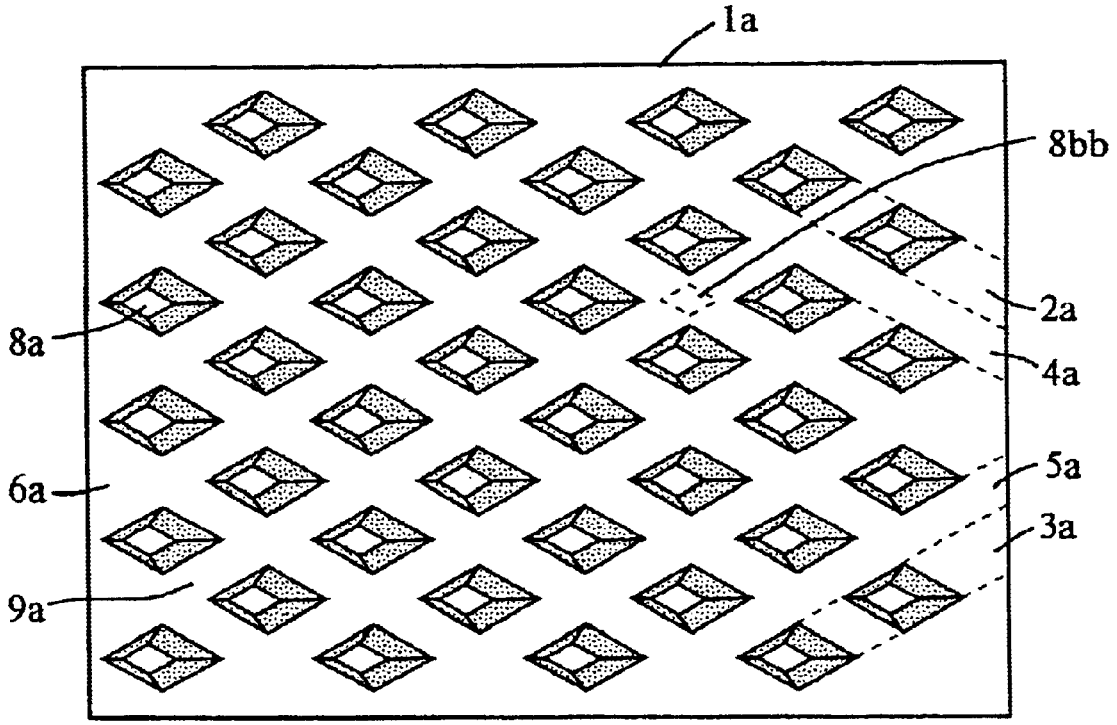
FIG. 7*a* shows an embodiment of the first pressing element according to the present invention in a plane view.
FIG. 7*b* shows an embodiment of the second pressing element according to the present invention in a bottom side plane view.
Figure 7:
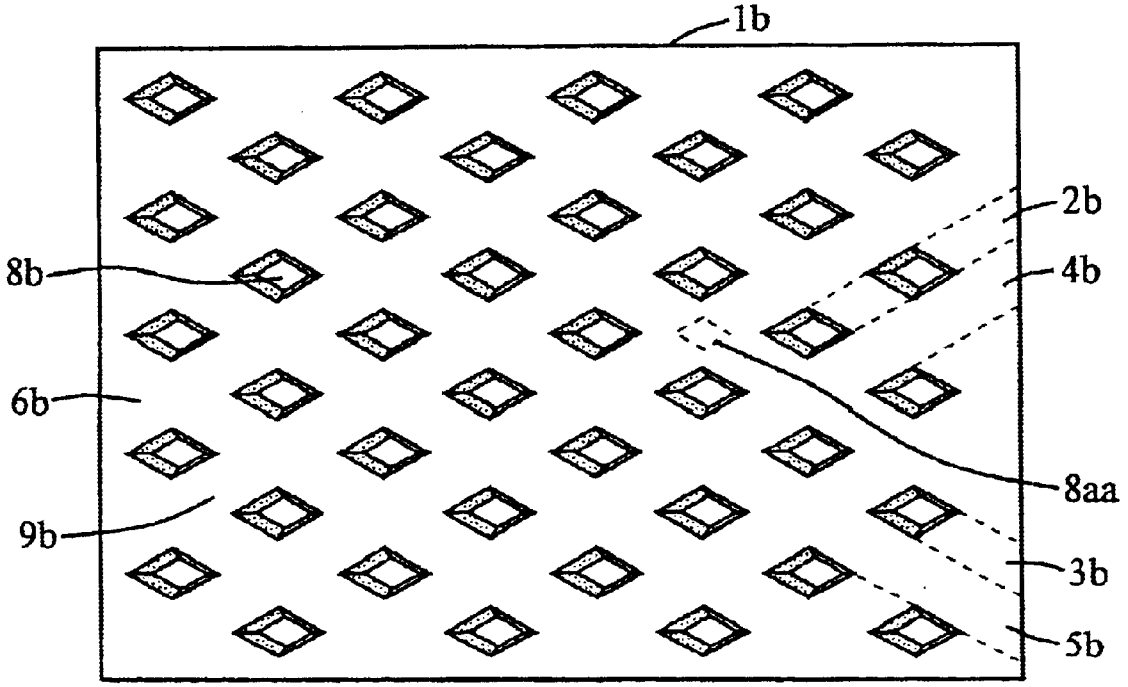

FIG. 6 shows still further embodiment of the apparatus for material preparation according to the present invention, wherein the first pressing element thereof is shown in FIG. 7(*a*) in a bottom side plane view and the second pressing element thereof is shown in FIG. 7(*b*). The manner of engagement of the first and the second pressing elements of an embodiment and another embodiment is shown in FIGS. 8(*a*) and 8(*b*), respectively, both in a vertical sectional view.

Figure 8:
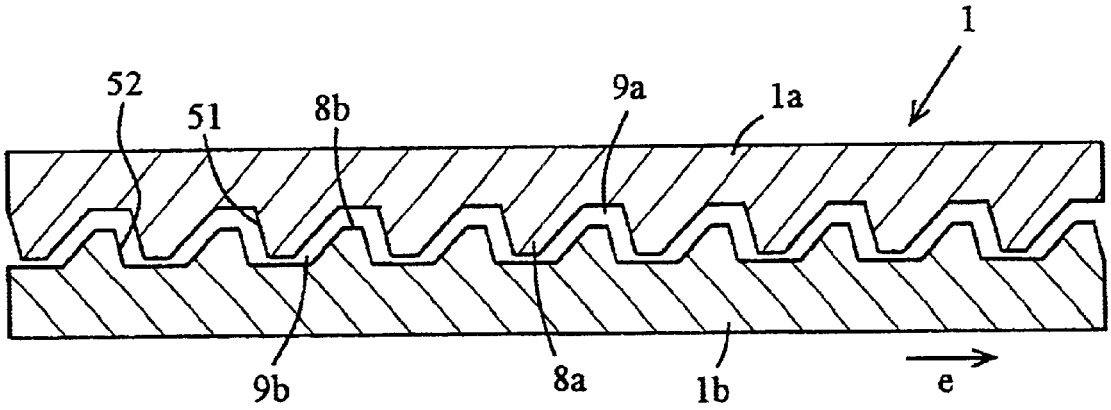
FIGS. 8*a* and 8*b* each show an embodiment of the pressing elements according to the present invention in the operating state in an illustrative sectional view.
Figure 8:
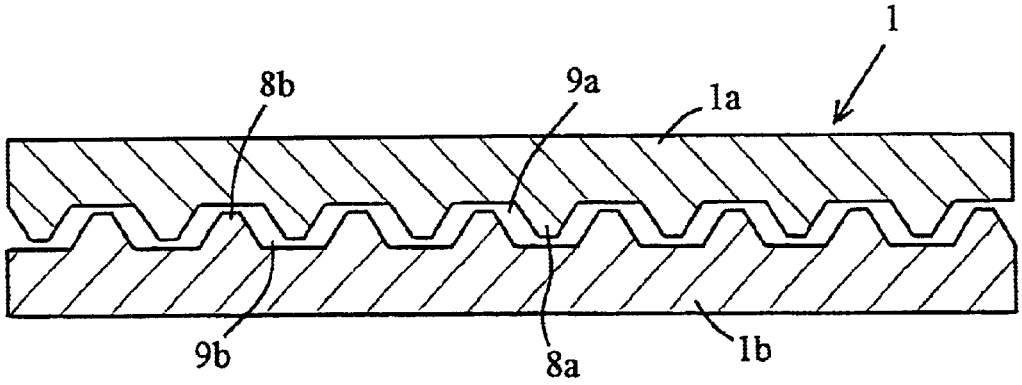

In the embodiments of FIGS. 6 to 8, the first and the second pressing elements 1*a* and 1*b* constructing the crusher 1 are each designed as a flat board having first and second pressing faces 6*a* and 6*b* on which protrusions 8*a* and 8*b* in a form of isolate islands surrounded by depressed marginal spaces 9*a* and 9*b* are arranged in parallel rows extending in directions crossing each other. The pressing faces 6*a* and 6*b* are in a form, in which the pressing faces 6*a* and 6*b* of the pressing elements in the crushing section 7*c* thereof shown in FIG. 1 are developed on a plane, and have protrusions 8*a* and 8*b* surrounded by depressed marginal spaces 9*a* and 9*b* formed in such a manner that the assumed first and the second parallel ridges 2*a*, 3*a* and 2*b*, 3*b* shown by the dotted lines on FIG. 7 are cut by the assumed first and second parallel grooves 4*a*, 5*a* and 4*b*, 5*b* extending in a direction crossing the ridges. Each of the protrusions 8*a* and 8*b* is arranged so that it protrudes into a part of the depressed marginal space on the counter pressing face, namely, into the depressed marginal spaces of the counter pressing face at the crossing position of the grooves. The position of the protrusion in this state is shown in FIGS. 7(*a*) and 7(*b*) by 8*aa* and 8*bb*, respectively.

In the apparatus for material preparation 11, the first pressing element 1*a* is assembled in such a manner that it can be pressed with the downwardly directed first pressing face 6*a* onto the second pressing element 1*b* by means of the action of a piston rod 42 operated by a hydraulic cylinder 41. The second pressing element 1*b* is arranged movably by being supported on rollers 43 with the pressing face 6*b* thereof on the upper side along the pressing face by the action of a piston rod 45 extending from the hydraulic cylinder 44 upon actuation thereof. 46 is a belt conveyer for supplying the material to be processed, 47 is a belt conveyer for taking out the processed product and 48 is a scraper.

For effecting crushing and producing processed product using the apparatus as given above, the material to be processed is supplied to the apparatus by means of the belt conveyer 46 in the state as shown in FIG. 6 so as to distribute the material over the second pressing element 1*b*. In the case of processing a material of a form of sheet, it is enough to cause the belt conveyer 46 to stop after the material is supplied. In the case of processing a material in a form of particles or the like, however, the scraper 48 is caused to move along the pressing face 6*b* to distribute the material uniformly over the pressing element 1*b*. In this state, the piston rod 42 is caused to extend down to cause the first pressing element to descend in order to press it onto the material, whereby the protrusions 8*a*, 8*b* are caused to intrude into the depressed marginal spaces 9*a*, 9*b* to thereby crush the material. In the case of a material of soft and easily extendable consistency, it may be deformed into an embossed form. When the second pressing element 1*b* is moved towards the direction indicated by the arrow e by protruding the piston rod 45, the material is crushed in a state partially cut by the knife edges 51 and 52 formed on one side of the protrusions 8*a* and 8*b*. The first pressing element 1*a* is then caused to ascend and the resulting preparation product is taken out by the belt conveyer. If the material is broken into fragments, these fragments can be collected by moving the scraper 48 in the direction of the arrow e and can be taken out by the belt conveyer 47.

In the case of a material be processed which is easily crushed, pressing elements having protrusions 8*a* and 8*b*, each exhibiting similar foreside and rearside faces, as shown in FIG. 8(*b*), may be employed. While the pressing elements 1*a* and 1*b* in the embodiments given above are arranged in a horizontal posture, they also may be disposed in other postures. Crushing may be realized by pressing the pressing elements onto each other by a reciprocal or a reciprocally rotating motion, even if one of them (1*a*) is designed in a form of a cylinder or in an arcuate form and the other one is designed in a form of plate.

EXAMPLES

Below, the present invention will be described by way of Examples.

Example 1

Using the apparatus for material preparation shown in FIG. 2 (with a sifting screen of 100 mesh), AYAHIKARI, a selected wheat, was processed by crushing. 50 grams of this wheat were supplied to the crusher 1 via the material port 20 and the crushing was effected for one minute at a rate of revolution of the pressing elements 1*a* and 1*b* of 100 r.p.m., whereby a wheat flour accumulated in the product chamber 29 was obtained by performing classification of the crushed crude product of wheat by the sifting screen 25 of the classifier 21.

Figure 9:
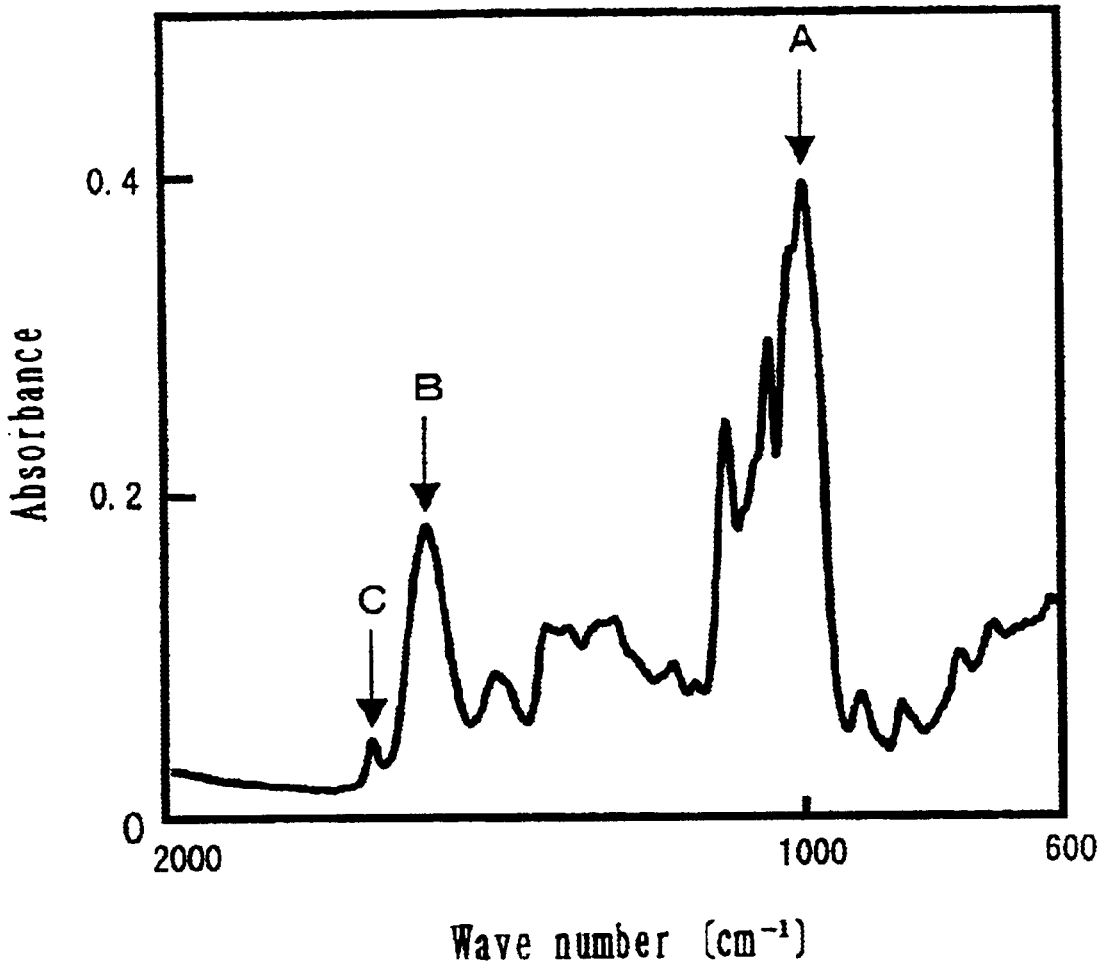
FIG. 9 is an infrared spectrophotometric chart of the preparation product of Example 1.

Using a microscopic infrared spectroanalyzer (of Nippon Bunko K.K.), the resulting wheat flour was examined for its spectrum absorbency. The results are recited in FIG. 9. In FIG. 9, A represents the absorption peak (ca. 1050 $cm^{-1}$) for carbohydrate (COC), B the absorption peak (ca. 1650 $cm^{-1}$) for protein (CONH) and C the absorption peak (ca. 1730 $cm^{-1}$) for fatty substance (CO).

As is clear from FIG. 9, absorption peaks for carbohydrates (COC), proteins (CONH) and fatty substances (CO) are recognized at corresponding wave numbers ($cm^{-1}$), so that the chemical composition of the material can be realized in an easy and convenient manner by detecting the ratio of the absorbencies for the protein, fatty substance and so on relative to that for the carbohydrate.

What is claimed is:

1. A crusher comprising a first pressing element having a first pressing face provided thereon with protrusions each in a form of an isolate island surrounded by depressed marginal spaces, the protrusions being disposed not only in first parallel rows but also in second parallel rows which extend in a direction crossing the first parallel rows, and a second pressing element to be held in engagement with the first pressing element when being pressed thereonto, the second pressing element having a second pressing face provided thereon with protrusions each in a form of an isolate island surrounded by depressed marginal spaces, the protrusions being disposed not only in first parallel rows but also in second parallel rows which extend in a direction crossing the first parallel rows, wherein the protrusions of the first and the second pressing elements are disposed in such a relationship that the protrusions of the first or the second pressing element will engage with corresponding depressed marginal spaces on the second or the first pressing face of the second or the first pressing element, respectively, so as to permit crushing of the material supplied to interspaces therebetween.

2. The crusher as claimed in claim 1, wherein the protrusions and the depressed marginal spaces of the first and the second pressing elements are formed in such a manner that first parallel ridges interspaced by first parallel grooves on each pressing element are cut by second parallel grooves thereon extending in a direction crossing the first parallel grooves.

3. The crusher as claimed in claim 1, wherein the first and the second pressing faces are each formed on a plane, curved, arcuate or cylindrical surface.

4. The crusher as claimed in claim 1, wherein it comprises a mechanism for moving at least one of the pressing elements so as to move the protrusions of either of the pressing faces relatively to the others, while both the pressing elements are pressed onto each other.

5. A crusher comprising a first rotatable pressing element in a form of a cylinder having a first cylindrical pressing face comprising screw sections disposed at both end regions of the cylinder and a crushing section disposed in the central region of the cylinder, wherein each of the screw sections is furnished with first parallel helical ridges interspaced by corresponding first parallel helical grooves or with second parallel helical ridges interspaced by corresponding second parallel helical grooves, respectively, the first ridges and grooves extending on the cylindrical pressing face in reverse turning sense to the second parallel helical ridges and grooves on the cylindrical pressing face in the other screw section, and wherein the crushing section is provided with protrusions of a form of isolate islands surrounded by depressed marginal spaces, which islands are formed in such a manner that the parallel helical ridges in extension of those on either one of the screw sections are cut by the parallel helical grooves in extension of those on the other one of the screw sections, and a second cylindrical pressing element to be held in engagement with the first pressing element rotatably in counter sense to the rotation of the first pressing element, which second pressing element has a second pressing face comprising screw sections disposed at both end regions of the cylinder and a crushing section disposed in the central region of the cylinder, wherein each of the screw sections is furnished with first parallel helical ridges interspaced by corresponding first parallel helical grooves or with second parallel helical ridges interspaced by corresponding second parallel helical grooves, respectively, the first ridges and grooves extending on the cylindrical pressing face in reverse turning sense to the second parallel helical ridges and grooves on the cylindrical pressing face in the other screw section, and wherein the crushing section is provided with protrusions of a form of isolate islands surrounded by depressed marginal spaces, which islands are formed in such a manner that the parallel helical ridges in extension of those on either one of the screw sections are cut by the parallel helical grooves in extension of those on the other one of the screw sections, wherein the ridges and protrusions of the first and the second pressing elements are disposed in such a relationship that the ridges and the protrusions on the first or the second pressing element will engage with corresponding grooves and depressed marginal spaces on the second or the first pressing element, respectively, so as to permit crushing of material supplied to the interspaces therebetween.

6. An apparatus for effecting material preparation, comprising a crusher comprising a first pressing element having a first pressing face provided thereon with protrusions each in a form of an isolate island surrounded by depressed marginal spaces, the protrusions being disposed not only in first parallel rows but also in second parallel rows which extend in a direction crossing the first parallel rows, and a second pressing element to be held in engagement with the first pressing element when being pressed thereonto, the second pressing element having a second pressing face provided thereon with protrusions each in a form of an isolate island surrounded by depressed marginal spaces, the protrusions being disposed not only in first parallel rows but also in second parallel rows which extend in a direction crossing the first parallel rows, wherein the protrusions of the first and the second pressing elements are disposed in such a relationship that the protrusions of the first or the second pressing element will engage with corresponding depressed marginal spaces on the second or the first pressing face of the second or the first pressing element, respectively, so as to permit crushing of material supplied to interspaces therebetween, a material port for supplying material to be processed to the crusher and a classifier for classifying crushed product from the crusher.

7. A process for effecting material preparation comprising the steps of supplying material to be processed to a crusher comprising a first pressing element having a first pressing face provided thereon with protrusions each in a form of an isolate island surrounded by depressed marginal spaces, the protrusions being disposed not only in first parallel rows but also in second parallel rows which extend in a direction crossing the first parallel rows, and a second pressing element to be held in engagement with the first pressing element when being pressed thereonto, the second pressing element having a second pressing face provided thereon with protrusions each in a form of an isolate island surrounded by depressed marginal spaces, the protrusions being disposed not only in first parallel rows but also in second parallel rows which extend in a direction crossing the first parallel rows, wherein the protrusions of the first and the second pressing elements are disposed in such a relationship that the protrusions of the first or the second pressing element will engage with corresponding depressed marginal spaces on the second or the first pressing face of the second or the first pressing element, respectively, so as to permit crushing of material supplied to interspaces therebetween and effecting crushing, mixing or homogenization of the so-supplied material by the crusher.

8. The process as claimed in claim 7, wherein it comprises the steps of supplying a soft material to be processed to the crusher and effecting deformation of the so-supplied material by pressing the material passing through the crusher.

9. The process as claimed in claim 7, wherein partial cutting of the material is effected by causing the first or the second pressing element to approach the counterpart pressing element to intrude the protrusions or ridges into the material.

10. A process for effecting material preparation comprising the steps of supplying material to be processed to a crusher comprising a first pressing element having a first pressing face provided thereon with protrusions each in a form of an isolate island surrounded by depressed marginal spaces, the protrusions being disposed not only in first parallel rows but also in second parallel rows which extend in a direction crossing the first parallel rows, and a second pressing element to be held in engagement with the first pressing element when being pressed thereonto, the second pressing element having a second pressing face provided thereon with protrusions each in a form of an isolate island surrounded by depressed marginal spaces, the protrusions being disposed not only in first parallel rows but also in second parallel rows which extend in a direction crossing the first parallel rows, wherein the protrusions of the first and the second pressing elements are disposed in such a relationship that the protrusions of the first or the second pressing element will engage with corresponding depressed marginal spaces on the second or the first pressing face of the second or the first pressing element, respectively, so as to permit crushing of material supplied to interspaces therebetween, effecting crushing, mixing or homogenization of the so-supplied material by the crusher and classifying the so-processed material.

* * * * *